US009543101B2

(12) United States Patent
Jang

(10) Patent No.: US 9,543,101 B2
(45) Date of Patent: Jan. 10, 2017

(54) ELECTROMAGNETIC CONTACTOR

(71) Applicant: LSIS CO., LTD., Anyang-si, Gyeonggi-do (KR)

(72) Inventor: Hyun Il Jang, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/738,714

(22) Filed: Jun. 12, 2015

(65) Prior Publication Data

US 2016/0049273 A1 Feb. 18, 2016

(30) Foreign Application Priority Data

Aug. 14, 2014 (KR) ..... 10-2014-0106011

(51) Int. Cl.

| | |
|---|---|
| ***H01H 3/00*** | (2006.01) |
| ***H01H 50/56*** | (2006.01) |
| ***H01H 50/18*** | (2006.01) |
| ***H01H 47/10*** | (2006.01) |
| ***H01H 50/20*** | (2006.01) |
| *H01H 50/54* | (2006.01) |

(52) U.S. Cl.

CPC ..... *H01H 50/56* (2013.01); *H01H 47/10* (2013.01); *H01H 50/18* (2013.01); *H01H 50/20* (2013.01); *H01H 50/546* (2013.01)

(58) Field of Classification Search

CPC ..... H01H 3/28; H01H 63/02; H01H 67/02; H01H 50/16; H01H 1/64

USPC ..... 335/192

See application file for complete search history.

(56) References Cited

U.S. PATENT DOCUMENTS

| | | | | |
|---|---|---|---|---|
| 6,424,243 | B1 | 7/2002 | Forster | |
| 9,275,814 | B2 * | 3/2016 | Lee | H01H 47/22 |
| 2009/0219119 | A1 * | 9/2009 | Lefebvre | H01H 50/021 335/202 |
| 2014/0077905 | A1 * | 3/2014 | Wu | H01H 3/06 335/131 |

(Continued)

FOREIGN PATENT DOCUMENTS

| | | |
|---|---|---|
| DE | 2336238 | 2/1975 |
| FR | 2686189 | 7/1993 |

(Continued)

OTHER PUBLICATIONS

European Patent Office Application Serial No. 15171146.2, Search Report dated Jan. 19, 2016, 8 pages.

(Continued)

*Primary Examiner* — Shawki S Ismail
*Assistant Examiner* — Lisa Homza
(74) *Attorney, Agent, or Firm* — Lee, Hong, Degerman, Kang & Waimey PC

(57) ABSTRACT

An electromagnetic contactor includes: a lower frame having an accommodation space therein; a bobbin having a fixed core, and accommodated in the lower frame; a movable core inserted into the bobbin so as to be moveable up and down; a spring installed between the bobbin and the movable core, and configured to provide an upward restoration force to the movable core; and a 'b' contact switch installed at one side of the bobbin, wherein a button for operating a switch lever of the 'b' contact switch is provided at a movable core plate positioned above the movable core.

3 Claims, 8 Drawing Sheets

(56) References Cited

U.S. PATENT DOCUMENTS

2015/0130569 A1* 5/2015 Jang ..... H01H 3/28
335/192

FOREIGN PATENT DOCUMENTS

| | | |
|---|---|---|
| GB | 191023831 | 0/1911 |
| JP | 55164747 | 11/1980 |
| JP | 5899748 | 7/1983 |
| JP | 618932 | 1/1986 |
| JP | 40681 | 4/1987 |
| JP | 2000276961 | 10/2000 |
| JP | 2007087632 | 4/2007 |
| JP | 2008097863 | 4/2008 |
| JP | 2012-15088 | 1/2012 |
| KR | 10-1529589 | 6/2015 |
| KR | 10-2015-0089780 | 8/2015 |
| WO | 2007/128892 | 11/2007 |
| WO | 2012/033262 | 3/2012 |

OTHER PUBLICATIONS

Korean Intellectual Property Office Application Serial No. 10-2014-0106011, Notice of Allowance dated Feb. 19, 2016, 5 pages.
Korean Intellectual Property Office Application Serial No. 10-2014-0106011, Office Action dated Sep. 18, 2015, 3 pages.
Japan Patent Office Application No. 2015-120854, Office Action dated Aug. 23, 2016, 3 pages.

* cited by examiner

ELECTROMAGNETIC CONTACTOR

CROSS-REFERENCE TO RELATED APPLICATION

Pursuant to 35 U.S.C. §119(a), this application claims the benefit of earlier filing date and right of priority to Korean Application No. 10-2014-0106011, filed on Aug. 14, 2014, the contents of which is incorporated by reference herein in its entirety.

BACKGROUND OF THE INVENTION

1. Field of the Invention

The present invention relates to an electromagnetic contactor, and more particularly, to an electromagnetic contactor including a 'b' contact switch at a coil circuit portion.

2. Background of the Invention

Generally, a direct current relay or an electromagnetic contactor is a type of electrical circuit switching device for performing a mechanical driving and transmitting a current signal using an electromagnet. The direct current relay or electromagnetic contactor is installed at various types of industrial equipment, machines, vehicles, etc.

The electromagnetic contactor may include a main contact mechanism for performing power supply to a load or disconnecting power supply to the load, and an auxiliary contact mechanism for performing power supply to a magnetic coil of the main contact mechanism or disconnecting power supply to the magnetic coil of the main contact mechanism.

FIG. 1 is an exploded perspective view of an electromagnetic contactor in accordance with the conventional art. FIG. 2 is a perspective view of a movable core of FIG. 1. FIG. 3 is a perspective view illustrating a state where a movable core of FIG. 1 is inserted into a bobbin. FIG. 4 is a longitudinal sectional view of an electromagnetic contactor in accordance with the conventional art.

As shown, the conventional electromagnetic contactor includes a lower frame 110, a bobbin 120, a spring 130, a movable core 140, a holder assembly 150, an upper frame 160, etc.

The upper frame 160 and the lower frame 110 are detachably assembled to each other, and form an accommodation space therein so as to accommodate the bobbin 120, the spring 130, the movable core 140, the holder assembly 150, etc.

The holder assembly 150 is provided with movable contacts 151 for respective phases. If the holder assembly 150 is downward moved, the movable contact 151 comes in contact with a fixed contact 152 installed at the bobbin 120. As a result, a current flows to a load side from a power side.

The movable core 140 includes a body portion 141 having a cylindrical shape, a movable core plate 142 coupled to an upper part of the body portion 141, and a coupling plate 144 coupled to an upper surface of the movable core plate 142. An extension portion 143 protrudes from a front surface of the movable core plate 142, and a switch manipulation protrusion 145 is provided on a lower surface of the extension portion 143.

The movable core 140 is inserted into the bobbin 120 so as to be movable up and down. When a magnetic field is applied to a coil 129, the movable core 140 moves downward by a magnetic force. Since the movable core 140 is in a coupled state to the holder assembly 150, it pulls the holder assembly 150 downward while performing a downward motion.

A fixed core 121 is installed at a core insertion portion 122 of the bobbin 120. A printed circuit board (PCB) 126 is provided on a front surface of the bobbin 120, and a 'b' contact switch 127 is installed at the PCB 126.

When a switch lever 128 is in an upwardly-moved state, the 'b' contact switch 127 connects an external power to the coil 129 to form a magnetic field at the coil 129. On the other hand, when the switch lever 128 is in a downwardly-moved state, the 'b' contact switch 127 makes an external power not be connected to the coil 120. In order for the movable core 140 to be moved downward, a large force is required initially. Accordingly, the movable core 140 is pulled by using a magnetic force of the coil 129. In a normal state, a magnetic force of the coil 129 may be removed, because a coupled state between the movable core 140 and the fixed core 121 is maintained by a sustained current. Accordingly, it is preferable to cut off an external power transmitted to the coil 129, as a switch manipulation protrusion 145 presses the switch lever 128 of the 'b' contact switch 127 after the movable core 140 has been moved downward.

However, in the conventional electromagnetic contactor, abrasion and damage occur due to repeated collisions between the switch manipulation protrusion 145 and the switch lever 128.

SUMMARY OF THE INVENTION

Therefore, an aspect of the detailed description is to provide an electromagnetic contactor capable of reducing transformation and damage of a lever of a 'b' contact switch of a movable core assembly.

To achieve these and other advantages and in accordance with the purpose of this specification, as embodied and broadly described herein, there is provided an electromagnetic contactor, including: a lower frame having an accommodation space therein; a bobbin having a fixed core, and accommodated in the lower frame; a movable core inserted into the bobbin so as to be moveable up and down; a spring installed between the bobbin and the movable core, and configured to provide an upward restoration force to the movable core; and a 'b' contact switch installed at one side of the bobbin, wherein a button for operating a switch lever of the 'b' contact switch is provided at a movable core plate positioned above the movable core.

In an embodiment, an extension portion may protrude from a front surface of the movable core plate, and an insertion portion for inserting the button may be formed at the extension portion in the form of a groove.

In an embodiment, the insertion portion may be formed to have a gourd bottle shape.

In an embodiment, the button may include a button body formed to have a cylindrical shape, and a circumferential groove may be formed along an outer circumferential surface of the button body.

In an embodiment, the button may be formed as an elastic member.

In an embodiment, the button may include a first button body having a cylinder shape, and a second button body having a piston shape.

In an embodiment, a coil spring may be disposed between the first button body and the second button body.

The electromagnetic contactor according to an embodiment of the present invention can have the following advantages.

Firstly, since the button for operating the 'b' contact switch is formed as an elastic member, an impact generated when a force is applied to the switch lever is attenuated. This can increase durability and reduce damage, thereby enhancing reliability of an operation of the 'b' contact switch.

Secondly, since the button is formed of various materials such as rubber or fiber, a user can select a material within a variety of ranges.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of preferred configurations of an electromagnetic contactor according to the present invention, with reference to the accompanying drawings.

Figure 1:
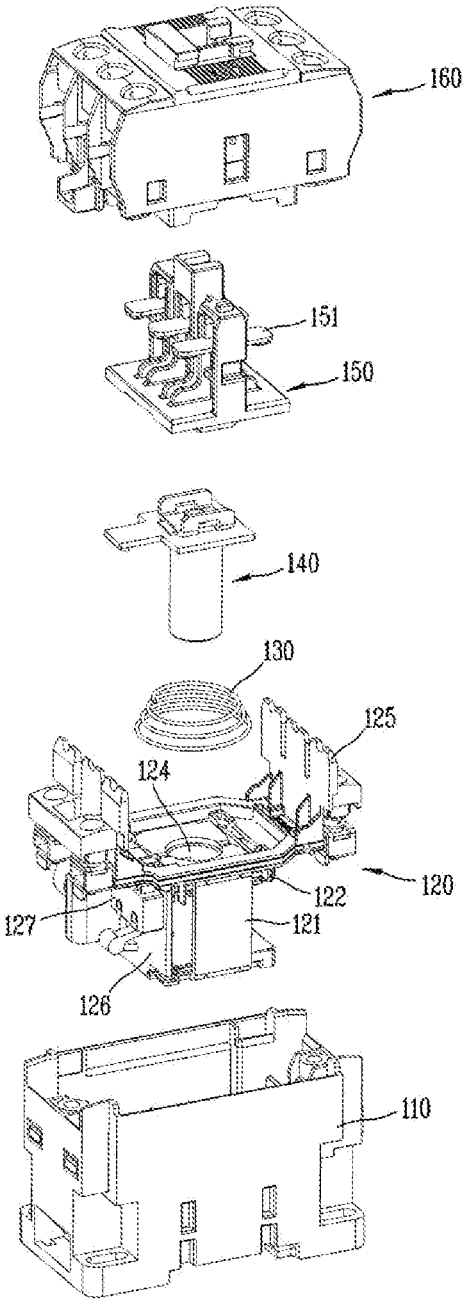
Fig. 1 Prior Art
FIG. 1 is an exploded perspective view of an electromagnetic contactor in accordance with the conventional art.
Figure 2:
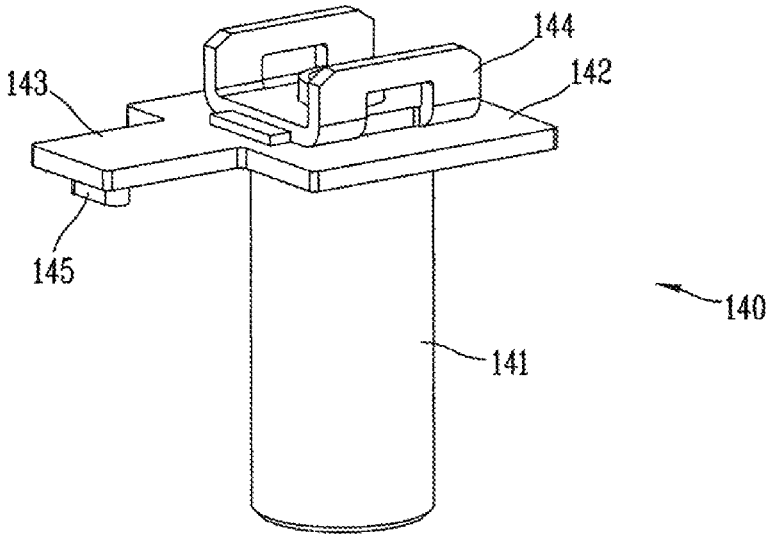
Fig. 2 Prior Art
FIG. 2 is a perspective view of a movable core of FIG. 1.
Figure 3:
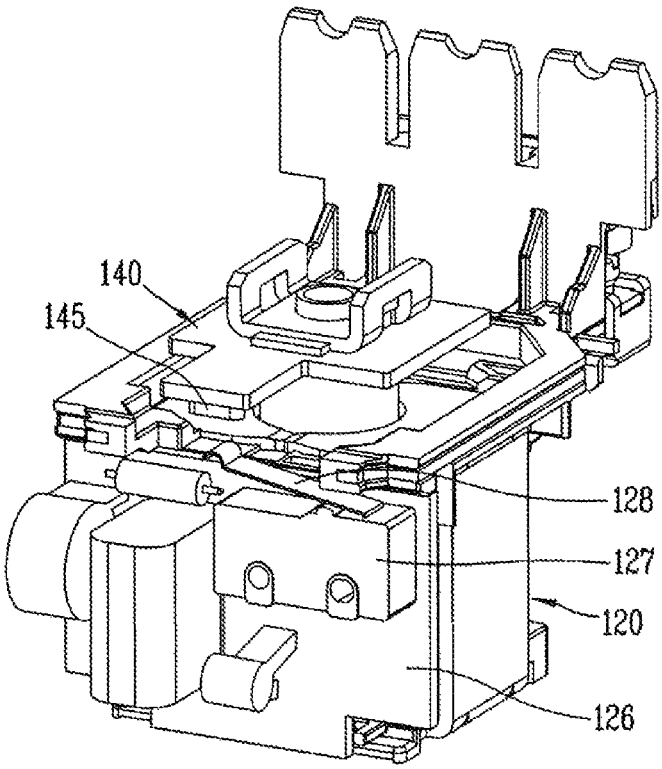
Fig. 3 Prior Art
FIG. 3 is a perspective view illustrating a state where a movable core of FIG. 1 is inserted into a bobbin.
Figure 4:
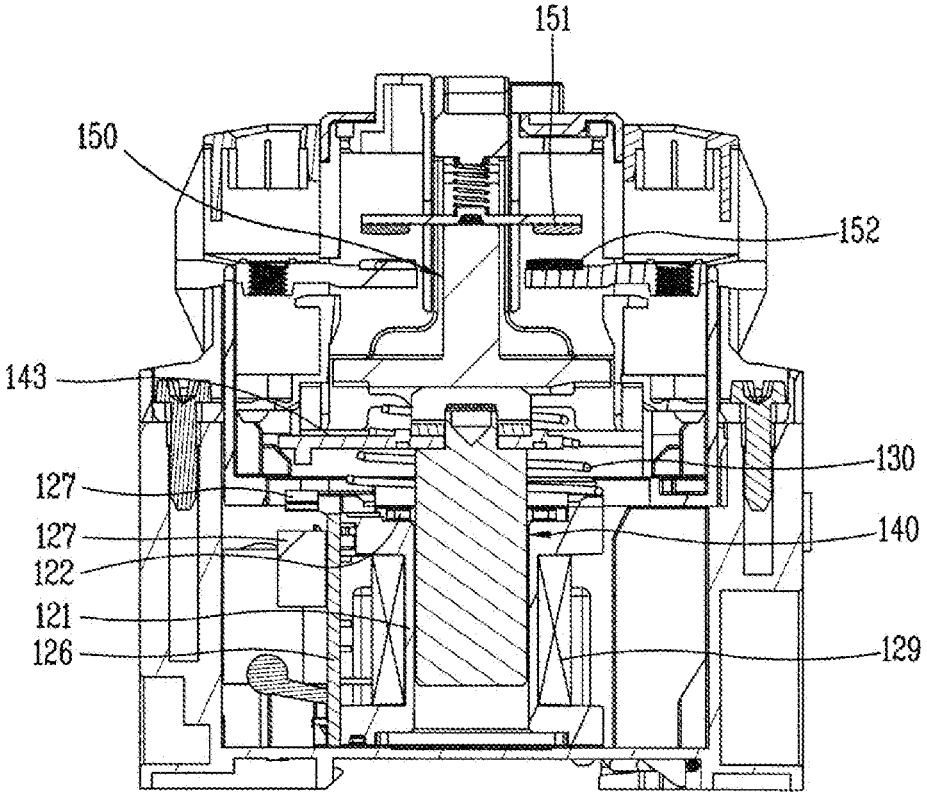
Fig. 4 Prior Art
FIG. 4 is a longitudinal sectional view of an electromagnetic contactor in accordance with the conventional art.
Figure 5:
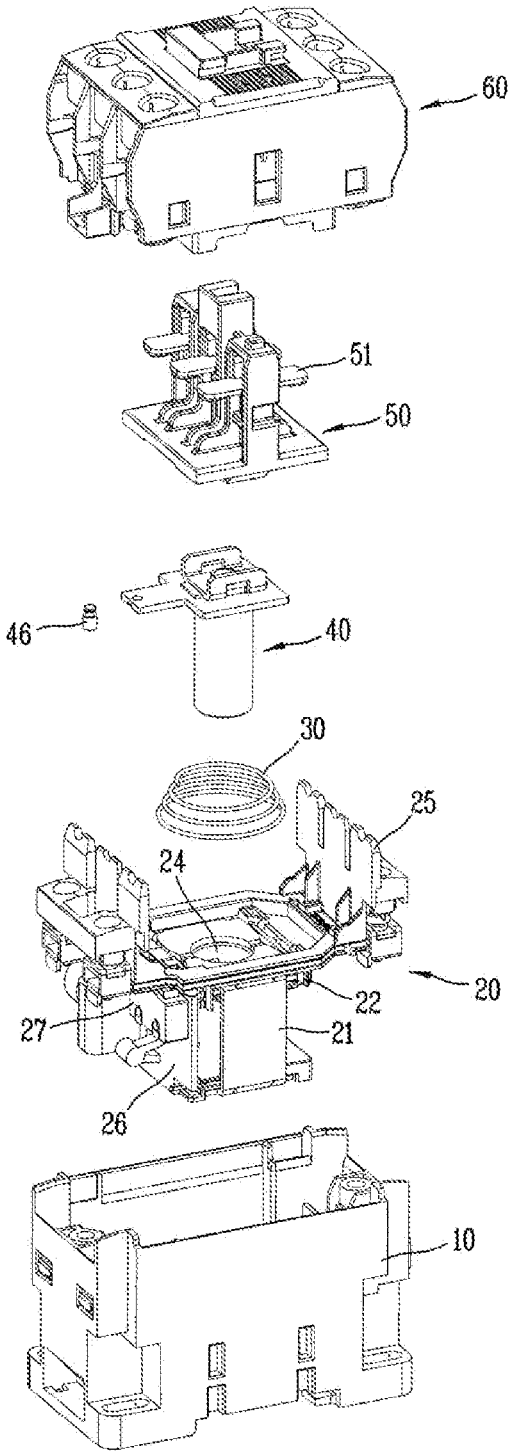
FIG. 5 is an exploded perspective view of an electromagnetic contactor according to an embodiment of the present invention.
Figure 6:
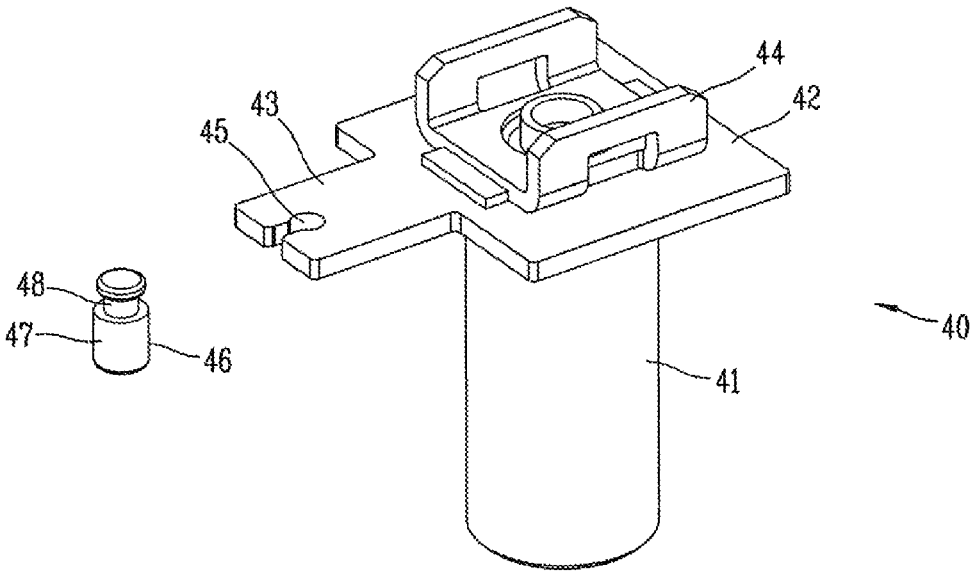
FIG. 6 is a perspective view of a movable core assembly according to an embodiment of the present invention.
Figure 7:
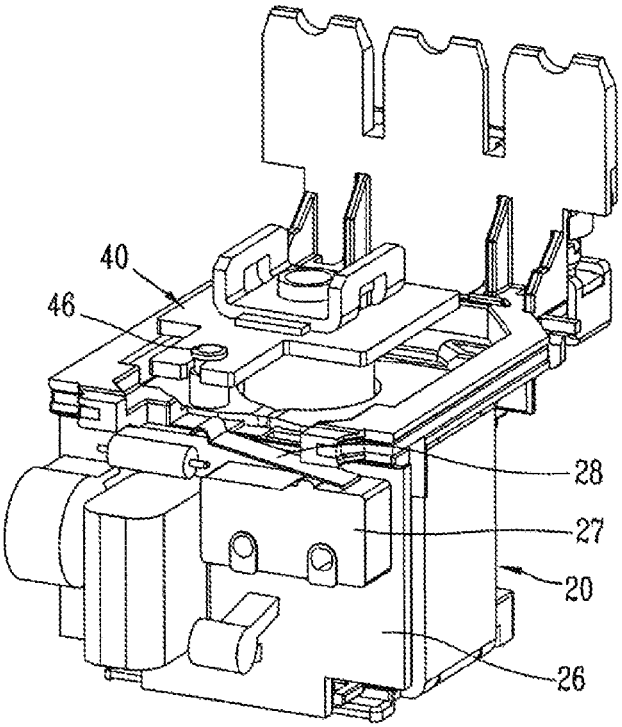
FIG. 7 is a perspective view illustrating a state where a movable core of FIG. 5 has been assembled into a bobbin.

FIG. 5 is an exploded perspective view of an electromagnetic contactor according to an embodiment of the present invention. FIG. 6 is a perspective view of a movable core assembly according to an embodiment of the present invention. FIG. 7 is a perspective view illustrating a state where a movable core of FIG. 5 has been assembled into a bobbin. Various embodiments of the present invention will be explained in more detail with reference to the attached drawings.

The electromagnetic contactor according to an embodiment of the present invention includes a lower frame 10 having an accommodation space therein; a bobbin 20 having a fixed core 21, and accommodated in the lower frame 10; a movable core 40 inserted into the bobbin 20 so as to be moveable up and down; a spring 30 installed between the bobbin 20 and the movable core 40, and configured to provide an upward restoration force to the movable core 40; and a 'b' contact switch 27 installed at one side of the bobbin 20. A movable core plate 42, which is positioned above the movable core 40, is provided with a button 46 for operating a switch lever 28 of the 'b' contact switch 27.

The lower frame 10 has a box shape where an upper surface is open, and the bobbin 20, the spring 30 and the movable core 40 to be explained later are accommodated in the lower frame 10. The lower frame 10 is detachably coupled to an upper frame 60 where a holder assembly 50 is mounted.

The holder assembly 50, accommodated in the upper frame 60, is provided with movable contacts 51. A fixed contact (not shown) is installed at two-side terminal walls 25 disposed above the bobbin 20. In case of a three-phase AC power, fixed contacts may be disposed at a power side and a load side for each phase, in parallel.

The bobbin 20 is provided with a bobbin body (not shown) long formed in upper and lower directions at a central part thereof. A fixed core 21 is installed around the bobbin body. Fixed core insertion portions 22 are provided at an upper end and a lower end of the bobbin 20.

The bobbin body (not shown) is provided with a cavity (hollow portion) 24 therein, and the movable core 40 is insertable into the bobbin body through the cavity 24. A coil (not shown) is wound on the bobbin body. Accordingly, if an external power is applied to the coil (not shown), a magnetic field is generated.

A printed circuit board 26 having an electronic circuitry portion is provided on a front surface of the bobbin 20, and the 'b' contact switch 27 is installed at the printed circuit board 26. The 'b' contact switch 27 serves to supply a current to the coil (not shown), or to disconnect power supply to the coil. In a normal state, the 'b' contact switch 27 is in an 'on' state. On the contrary, when the switch lever 28 is pressed, the 'b' contact switch 27 is in an 'off' state.

The holder assembly 50 is installed in the upper frame 60 so as to be moveable up and down, and is provided with movable contacts 51 protruding toward a power side and a load side in parallel.

The movable contacts 51 are elastically supported by elastic springs, and are disposed above fixed contacts (not shown) with a distance therebetween. As aforementioned, the movable contacts 51 may be provided with the same number as phases.

The movable core 40 has a cylindrical structure, and is inserted into the bobbin 20. The movable core 40 includes a body portion 41 having a cylindrical shape, a movable core plate 42 coupled to an upper part of the body portion 41, and a coupling plate 44 having a 'U'-shape and coupled to an upper surface of the movable core plate 42.

As the body portion 41 of the movable core 40 is inserted into the cavity 24 of the bobbin 20, the movable core 40 is moveable up and down. In this case, a movement force is provided from the holder assembly 50 to which the coupling plate 44 is fixed.

An extension portion 43 protrudes from a front surface of the movable core plate 42, and an insertion portion 45 for inserting a button 46 to be explained later is formed on a front surface of the extension portion 43. The insertion portion 45 may be formed as a groove of a gourd bottle.

The button 46 is fixed into the insertion portion 45. The button 46 is formed as a circumferential groove 48 to be fitted into the insertion portion 45 is formed at a button body 47 having a cylindrical shape. The button 46 performs an up-down motion by being installed at the movable core plate 42. The button 46 presses the switch lever 28 while downward moving.

The button 46 may be formed as an elastic member. The elastic member may be formed of rubber, fiber, etc. As the button 46 is formed as the elastic member, an impact generated when a force is applied to the switch lever 28 is attenuated. This can increase durability and reduce damage.

An operation of the electromagnetic contactor according to an embodiment of the present invention will be explained in more detail.

Once a current of an external power is applied to a coil (not shown) through the 'b' contact switch 27, a magnetic field is generated around the coil. And the bobbin 20 and the fixed core 21 are magnetized by the magnetic field. The movable core 40 is sucked into the fixed core 21 by a magnetic force generated from the magnetized bobbin 20 and fixed core 21, thereby being moved downward. As a result, the movable contact 51 comes in contact with the fixed contact (not shown), so that a current flows from a power side to a load side.

The button 46, coupled to the extension portion 43 of the movable core 40, presses the switch lever 28 while moving downward. As the switch lever 28 is pressed, the 'b' contact switch 27 is in an 'off' state, and a current from an external power flows into the coil with a value reduced through a resistance (not shown). As a result, a contacted state between the movable contact 51 and the fixed contact is maintained.

Figure 8:
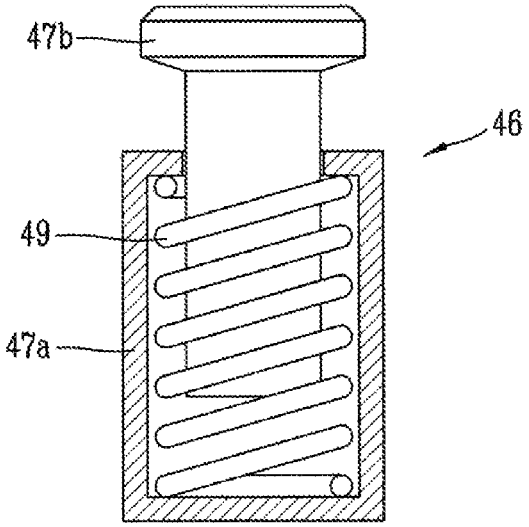
FIG. 8 is a longitudinal sectional view of a button according to another embodiment of the present invention.

FIG. 8 illustrates another embodiment of the button 46 applied to the electromagnetic contactor according to the present invention.

Button bodies 47*a*, 47*b* may include a first button body 47*a* having a cylinder shape, and a second button body 47*b* having a piston shape. A coil spring 49 is disposed between the first button body 47*a* and the second button body 47*b*, thereby providing an elastic force. Since the first button body 47*a* and the second button body 47*b* are elastically moveable, they may be formed of various materials such as synthetic resin or steel.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electromagnetic contactor, comprising:

a lower frame comprising an opening defining an accommodation space;

a bobbin comprising a fixed core and configured to be accommodated in the lower frame;

a movable core configured to be inserted into the bobbin and moveable up and down;

a spring disposed between the bobbin and the movable core and configured to provide an upward restoration force to the movable core;

a 'b' contact switch disposed at one side of the bobbin;

a movable core plate disposed above the movable core;

a button disposed at the movable core plate and configured to operate a switch lever of the 'b' contact switch as the movable core is moved up and down;

an extension portion extending from a front surface of the movable core plate; and an insertion portion disposed at the extension portion and comprising a groove configured to accommodate the button, wherein the button is formed as an elastic member and is fixedly coupled to the insertion portion.

2. The electromagnetic contactor of claim 1, wherein the insertion portion comprises an opening defining an opening portion and a fixing portion, wherein a width of the opening portion is smaller than a width of the fixing portion.

3. The electromagnetic contactor of claim 1, wherein the button comprises a button body having a cylindrical shape and a circumferential groove along an outer circumferential surface of the button body.

* * * * *